US008537183B2

(12) United States Patent
Yamamoto

(10) Patent No.: US 8,537,183 B2
(45) Date of Patent: Sep. 17, 2013

(54) PRINTING DEVICE AND DATA WRITING METHOD THEREOF

(75) Inventor: Kenta Yamamoto, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 266 days.

(21) Appl. No.: 13/218,629

(22) Filed: Aug. 26, 2011

(65) Prior Publication Data

US 2012/0050442 A1 Mar. 1, 2012

(30) Foreign Application Priority Data

Aug. 30, 2010 (JP) ..... 2010-192681

(51) Int. Cl.
*B41J 2/00* (2006.01)

(52) U.S. Cl.
USPC ..... 347/110

(58) Field of Classification Search
None
See application file for complete search history.

(56) References Cited

FOREIGN PATENT DOCUMENTS

JP 2007-313901 12/2007

*Primary Examiner* — Stephen Meier
*Assistant Examiner* — Tracey McMillion
(74) *Attorney, Agent, or Firm* — Turocy & Watson, LLP

(57) ABSTRACT

According to one embodiment, a printing device includes a printing unit configured to print on a recording medium including a wireless tag and a conveying unit configured to convey the recording medium to the printing unit along a conveying path. The printing device further includes an antenna unit configured to write data on the wireless tag by radiating an electromagnetic wave, a moving unit configured to move the antenna unit along the conveying path, and a control unit configured to control the moving unit to move the antenna unit so that the antenna unit is capable of writing data on the wireless tag, while the conveying unit is conveying the recording medium to the printing unit.

14 Claims, 7 Drawing Sheets

PRINTING DEVICE AND DATA WRITING METHOD THEREOF

CROSS-REFERENCE TO RELATED APPLICATION

This application is based upon and claims the benefit of priority from Japanese Patent Application No. 2010-192681, filed on Aug. 30, 2010, the entire contents of which are incorporated herein by reference.

FIELD

Embodiments described herein relate generally to a printing device and a data writing method thereof for a recording medium such as a wireless tag, the printing device performing printing on the recording medium and performing data writing on the wireless tag.

BACKGROUND

Recently, printing devices have complicated and various functions and purposes and are required to perform various types of printing functions or operations. For example, printing devices perform printing on a recording medium having a label attached on a backing sheet and also write data (transmitted from an antenna) on a wireless tag provided on the label.

In such a printing device, when the printing on the recording medium is performed concurrently with the data writing on the wireless tag provided on the recording medium, accurate data writing on the wireless tag may not be accomplished. This is due to an antenna for use in data writing on the wireless tag being placed at a fixed location, while the recording medium (including the wireless tag) is being conveyed during the printing process. This may make it difficult to maintain an appropriate distance between the wireless tag and the antenna. To accomplish accurate data writing on the wireless tag, a conveying mechanism may need to be halted during the process of data writing on the wireless tag. However, as a result, the entire processing time of the printing device may be prolonged.

DETAILED DESCRIPTION

According to one embodiment, a printing device includes a printing unit configured to print on a recording medium including a wireless tag and a conveying unit configured to convey the recording medium to the printing unit along a conveying path. The printing device further includes an antenna unit configured to write data on the wireless tag by radiating an electromagnetic wave, a moving unit configured to move the antenna unit along the conveying path, and a control unit configured to control the moving unit to move the antenna unit so that the antenna unit is capable of writing data on the wireless tag, while the conveying unit is conveying the recording medium to the printing unit.

Figure 3:
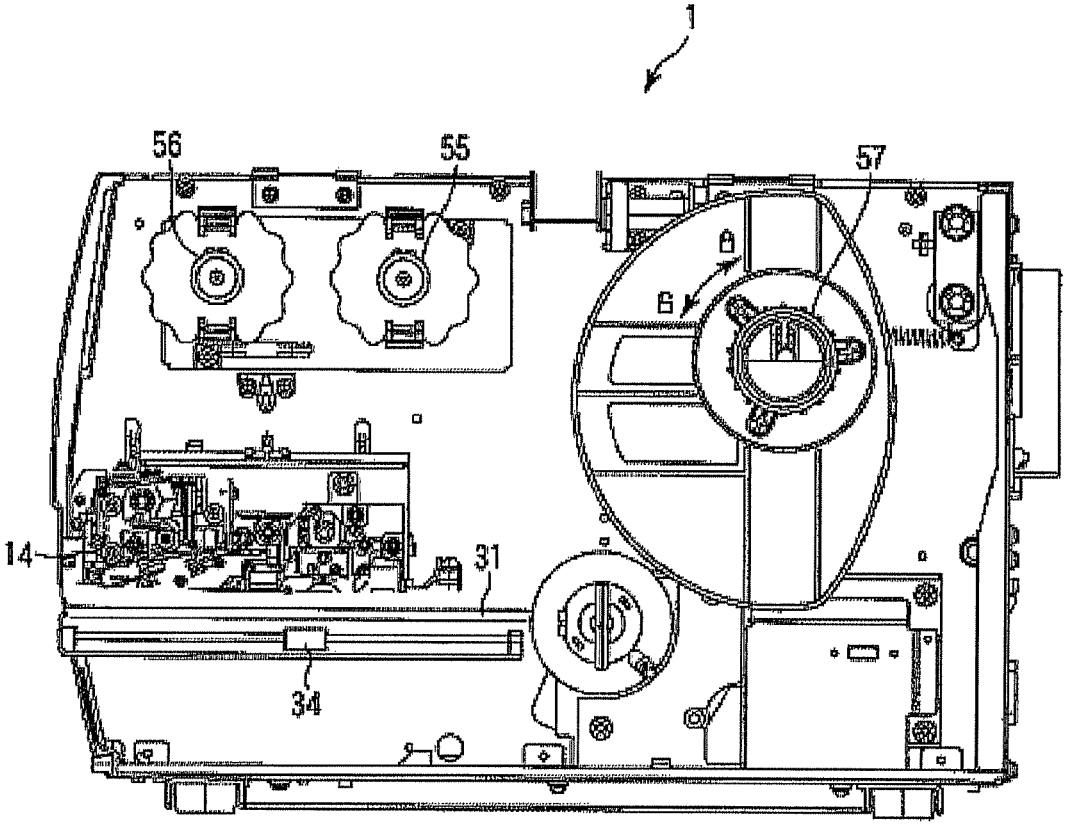
FIG. 3 is a side view showing an example of the mechanical structure of the interior of the printing device.
Figure 4:
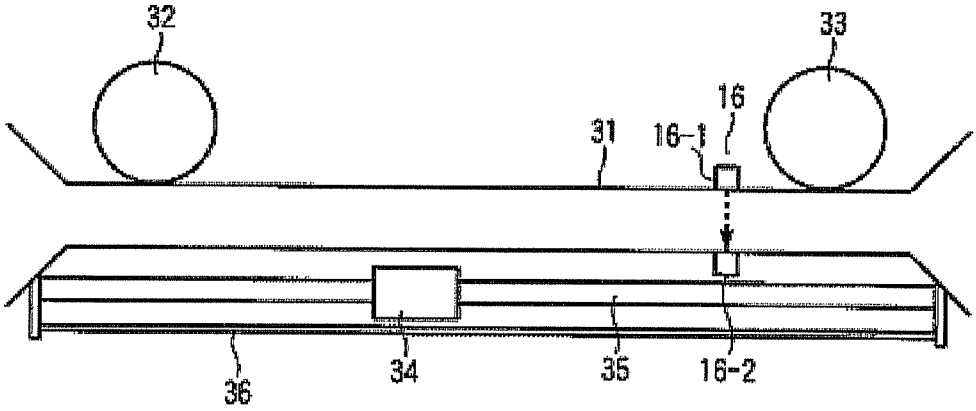
FIG. 4 illustrates an example of the mechanical configuration of the printing device.
Figure 5:
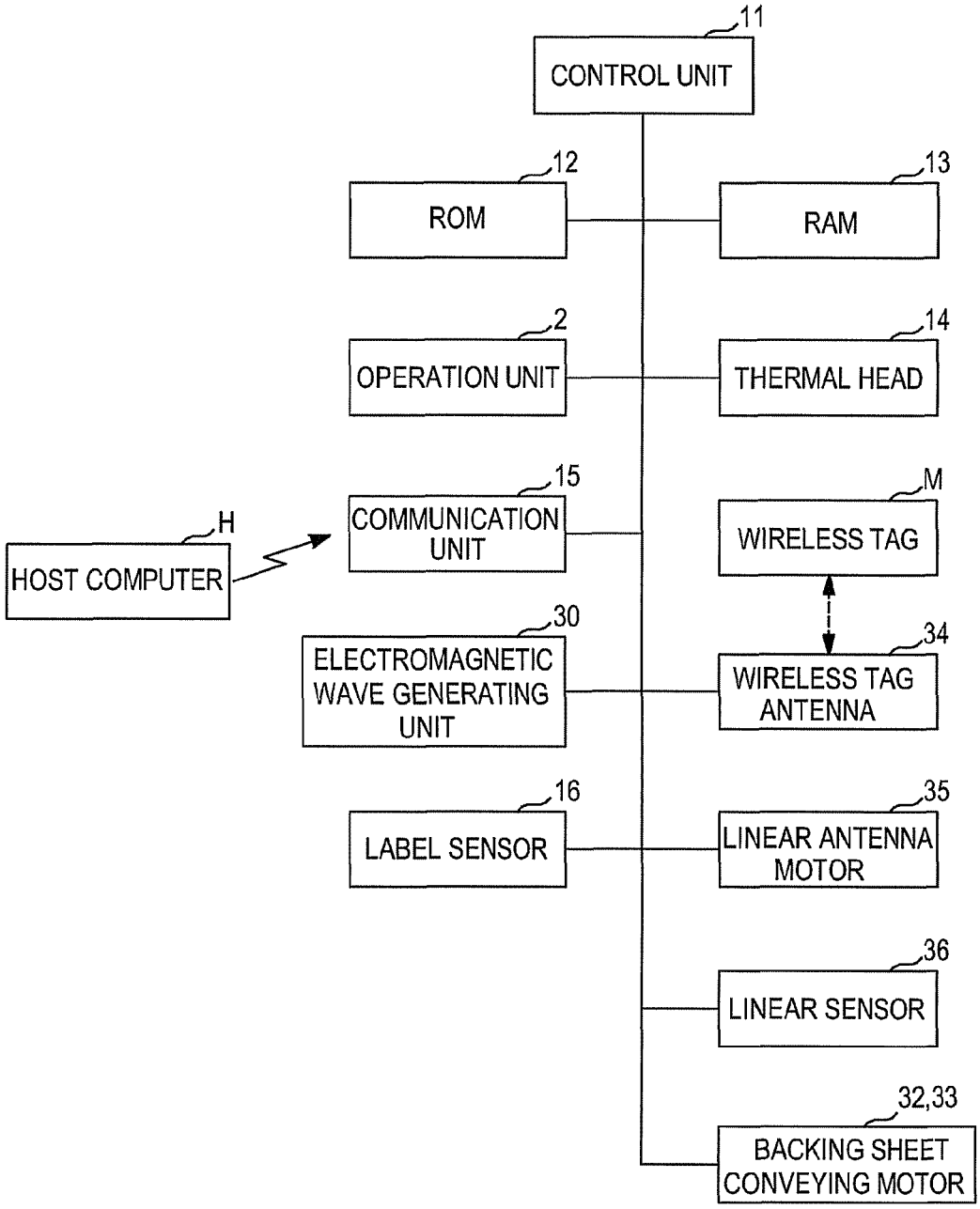
FIG. 5 is a block diagram showing an example of a functional configuration of the printing device.

Some embodiments will now be described in detail with reference to the drawings. A printing device 1 according to an embodiment will be described referring to FIGS. 1 to 5. The printing device 1 according to the present embodiment includes a control unit 11 configured to control the entire operation, an operation unit 4 provided on the front side of the printing device 1 and configured to provide an operation signal to the control unit 11 in response to operation by a user, and a display unit 3, e.g., employing an LCD (Liquid Crystal Display) or the like, configured to display operation information, an operation menu, etc. The display unit 3 may be provided, e.g., on the front side of the printing device 1. The printing device 1 further includes a ROM (Read Only Memory) 12 and a RAM (Random Access Memory) 13 configured to store the operation information, setting information, and operating program, etc., a thermal head 14 configured to print on a recording medium such as a label under the control of the control unit 11. Further, the printing device 1 includes a communication unit 15 configured to communicate with an external host computer H to which a user inputs an instruction for printing, information about the recording medium (e.g., values a, b and c, which will be described later in detail) and the like, and a label sensor 16 configured to detect a label 41 (which will be described later referring to FIG. 6) by detecting a light transmittance of a backing sheet D using a light emitting unit 16-1 and a light receiving unit 16-2, as shown in FIG. 4. FIG. 4 is an enlarged view of a conveying path 31 for a wireless tag M, a linear antenna motor 35 ("linear motor") provided to be parallel with the conveying path 31, and a linear sensor 36 configured to detect the current position of a wireless tag antenna 34 ("antenna unit"). The label sensor 16 may be implemented with a sensor configured to detect the light transmittance of the backing sheet D. Alternatively, the label sensor 16 may be implemented using, for example, a reflection sensor configured to emit a light on a backing sheet D having a top surface with a label attached thereon and a bottom surface with black marks printed thereon, so that a position of the label 41 (see FIG. 6) can be detected based on a light reflectivity difference between parts on which the black marks are printed and the parts on which the black marks are not printed.

Figure 1:
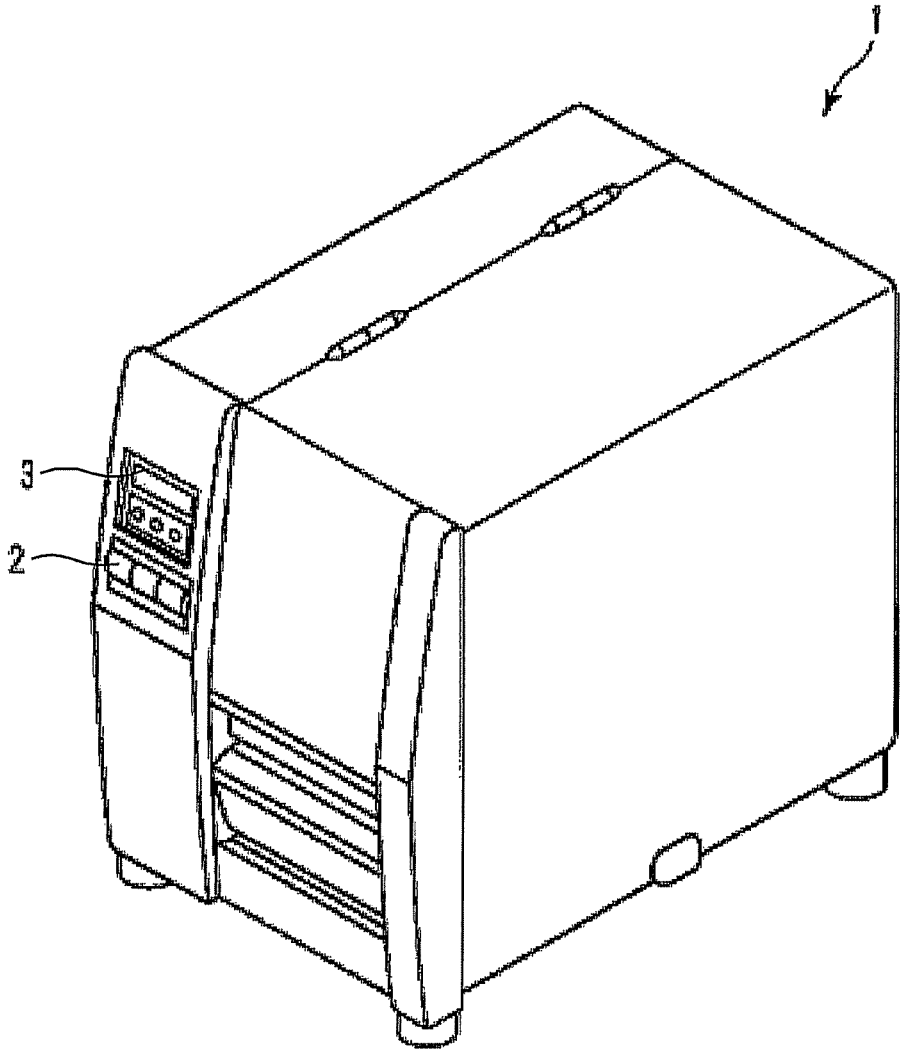
FIG. 1 is an exterior view showing an example of the exterior of a printing device according to one embodiment.
Figure 2:
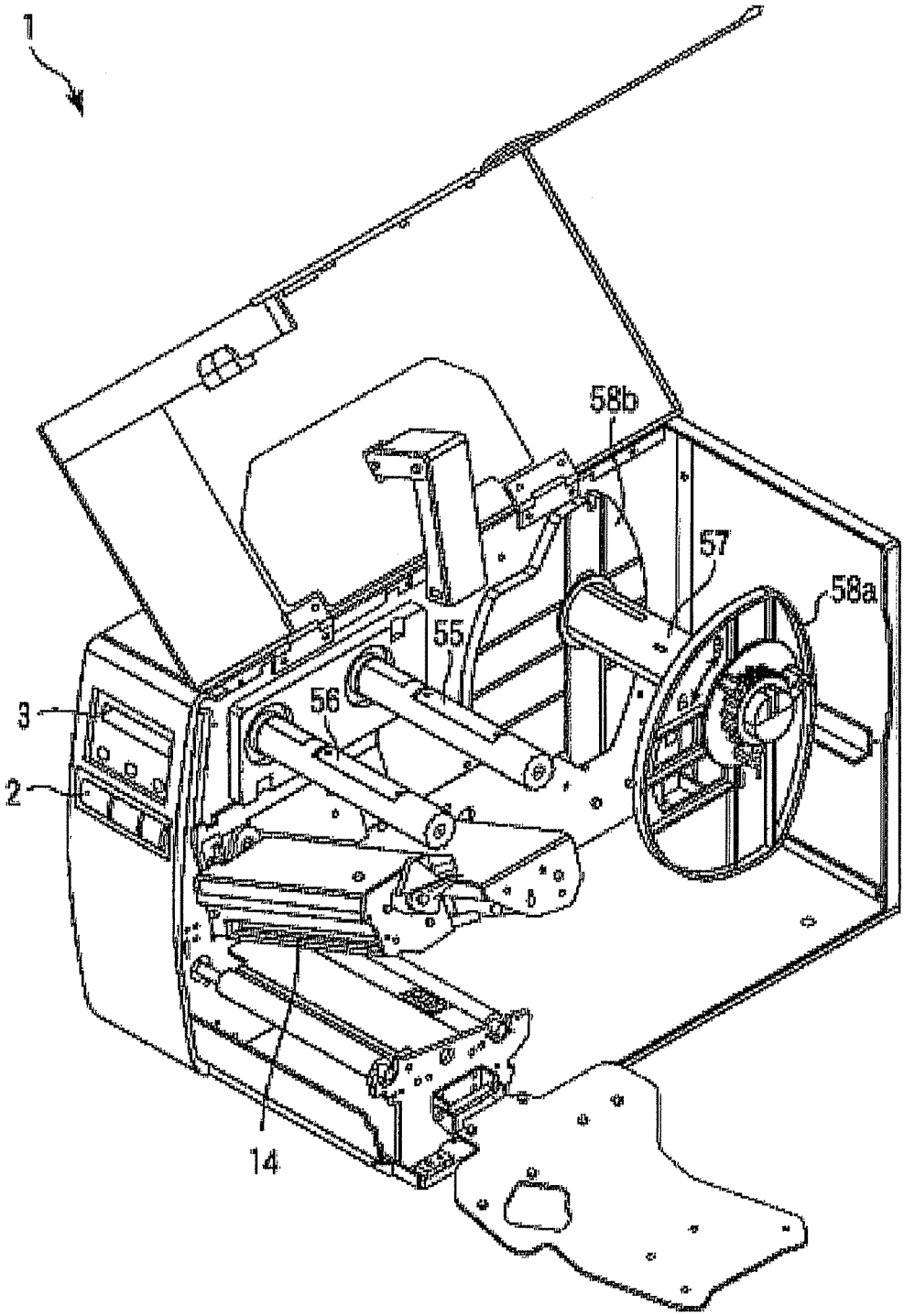
FIG. 2 is an interior view showing an example of the interior of the printing device.

The printing device 1 further includes an electromagnetic wave generating unit 30 (see FIG. 5) configured to generate an electromagnetic wave used for writing data to the wireless tag M. Further, the printing device 1 includes the conveying path 31 along which a backing sheet D with a recording medium (e.g., a label) attached thereon is conveyed, and backing sheet conveying motors 32 and 33 configured to drive conveyance of the backing sheet D. The wireless tag antenna 34 is configured to receive the electromagnetic wave from the electromagnetic wave generating unit 30 and radiate the received electromagnetic wave for writing data onto the wireless tag M. The linear antenna motor 35 is configured to linearly move the wireless tag antenna 34, and the linear sensor 36 is configured to detect the current position of the wireless tag antenna 34. As shown in FIGS. 2 and 3, the printing device 1 further includes an ink ribbon supply shaft 55, a ribbon take-up shaft 56, a paper holding shaft 57, and a pair of side fences 58*a* and 58*b*.

With the above configuration, in response to a user's operation on the operation unit 4 or an instruction from the host computer H and under the control of the control unit 11, the printing device 1 is operated to print, for example, price information, on a label attached on a backing sheet D with the thermal head 14 and to convey the backing sheet D by the backing sheet conveying motors 32 and 33, so that a printed recording medium (i.e., the label) is provided to the outside of the printing device 1.

Figure 6:
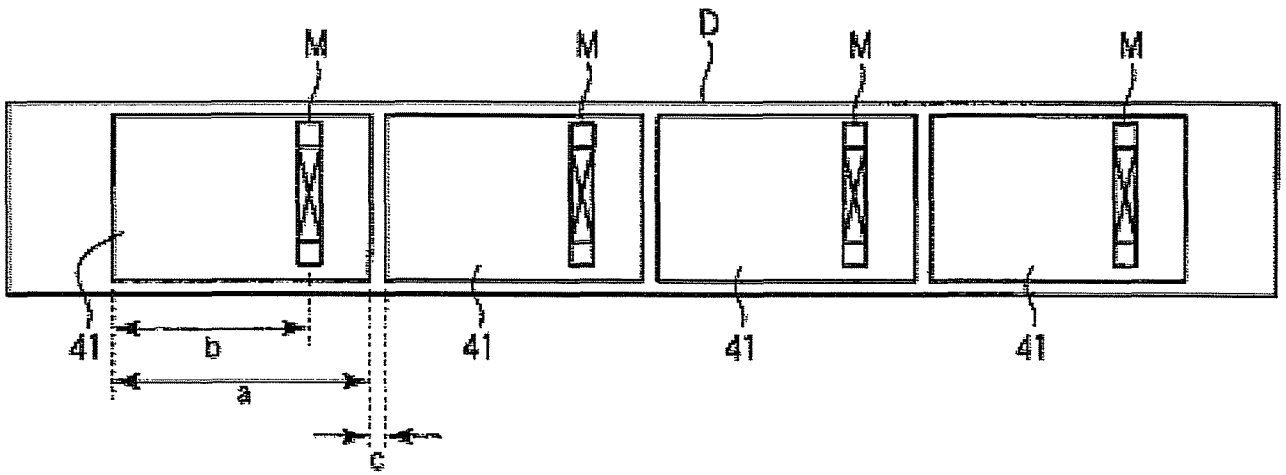
FIG. 6 illustrates an example of a backing sheet with a wireless tag used in the printing device.

Further, as an example of a printing paper for use in the printing device 1, a plurality of the labels 41 may be attached on the backing sheet D, each label 41 having the wireless tag M attached thereon, as shown in FIG. 6. In this embodiment, information on the backing sheet D, for example, values a, b and c, respectively indicating a size of the label 41, an attachment position of the wireless tag M, and a space between the labels, may be inputted, e.g., by means of the operation unit 4, and stored in the control unit 11, as will be described later.

In the present embodiment, the printing device 1 is operated to write data on the wireless tag M by the wireless tag antenna 34 (in addition to printing on the label 41). Alternatively, the printing device 1 may print only on the label 41 without the wireless tag M attached thereon and also may print on a simple recording medium such as a printing paper without the label 41 attached thereon.

In the following, a data writing process on a wireless tag M by the printing device 1 according to one embodiment will be described in detail referring to the flow chart in FIG. 7. The data writing process may be performed on the wireless tag M concurrently with the printing process on the label 41 with the wireless tag M attached thereon. In this case, the two processes are performed in parallel with each other or partially in parallel with each other, thereby reducing the entire processing time. In this embodiment, the data writing process on the wireless tag M on the label 41 is performed while moving the wireless tag antenna 34 along with the movement of the wireless tag M, so that the wireless tag antenna 34 and the wireless tag M are placed within a distance in which the wireless tag antenna 34 can write data on the wireless tag M. This data writing process is performed concurrently with the movement of the backing sheet D toward the thermal head 14 by the backing sheet conveying motors 32 and 33 in the printing process.

As described above, in the case of using a wireless tag antenna 34 fixed at a certain location, the backing sheet conveying motors 32 and 33 may be required to be paused in order to prevent the deterioration of data writing accuracy. However, according to the embodiment, the linear antenna motor 35 mounting the wireless tag antenna 34 thereon is configured to move substantially at the same speed as the conveying speed of the backing sheet conveying motors 32 and 33. This configuration eliminates the need for decelerating the conveying speed of the backing sheet conveying motors 32 and 33 during the data writing process.

Figure 7:
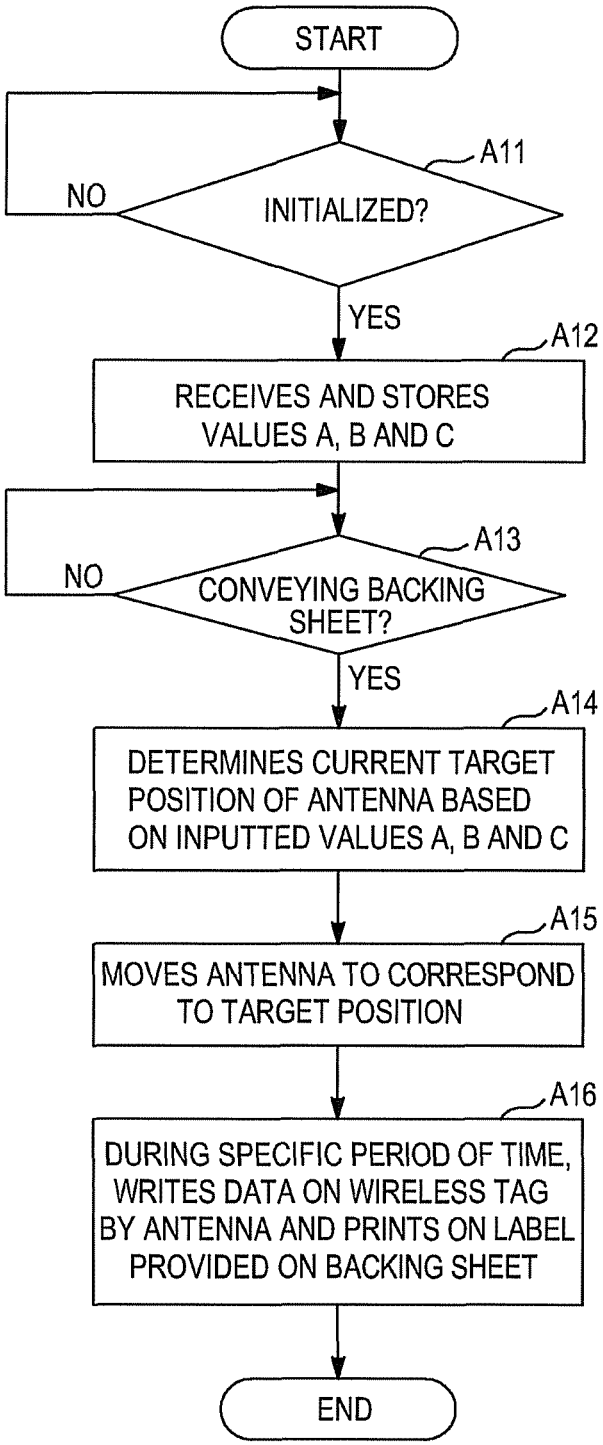
FIG. 7 is a flow chart showing an example of a process of writing data to the wireless tag in the printing device.

Specifically, as shown in the flow chart in FIG. 7, the control unit 11 detects whether the printing device 1 is powered on and initialized for a printing operation (Act A11). When the initialization of the printing device 1 is detected (i.e., "YES" of Act A11), the control unit 11 receives information on the backing sheet D, for example, the values a, b and c respectively indicating the size of the label 41, the attachment position of the wireless tag M with respect to the label 41 and the space between the labels 41, via the communication unit 15 from the external host computer H, and stores the received values a, b and c in a memory area such as the RAM 13 (Act A12). Alternatively, the values a, b and c may be inputted from an operation panel of the operation unit 4.

If the backing sheet conveying motors 32 and 33 are operated to drive conveyance of the backing sheet D (Act A13), the control unit 11 determines a current position of a target wireless tag M, based on the pre-inputted values a, b and c, and a previous position and current conveying speed of the movement of the target wireless tag M. Further, the control unit 11 designates the current position of the current target wireless tag M as an optimum position of the wireless tag antenna 34, which is to be moved by the linear antenna motor 35 along the conveying path 31 of the target wireless tag M (Act A14). Based on the current position of the wireless tag antenna 34 detected by the linear sensor 36, the control unit 11 controls the linear antenna motor 35 to move the wireless tag antenna 34 to reach the determined current position of the current target wireless tag M, so that the wireless tag antenna 34 can follow the current target wireless tag M moving along the conveying path 31 thereof substantially at the same speed (Act A15). While the wireless tag antenna 34 is moving together with the target wireless tag M at the same speed, the wireless tag antenna 34 does not move substantially in relation with the target wireless tag M (i.e., there is no relative movement therebetween). The data writing process is done simultaneously as the printing on the label 41 provided on the backing sheet D is being performed (Act A16).

In the above operations, the position of the wireless tag antenna 34 does not necessarily need to completely correspond to the determined current position of the wireless tag M. In other words, the wireless tag antenna 34 may be slightly apart from the wireless tag M as long as they are close to each other enough to reliably write data to the wireless tag M (e.g., within a communication range of the antenna).

In this embodiment, while the wireless tag antenna 34 is moving to follow the target wireless tag M, the backing sheet conveying motors 32 and 33 can continue conveying the wireless tag M to the thermal head 14 without slowing down the moving speed of the wireless tag M. However, if the time required for writing on the wireless tag M is longer than the time required for moving the label 41 with the wireless tag M attached thereon to the thermal head 14 by the backing sheet conveying motors 32 and 33, the moving speed of the backing sheet conveying motors 32 and 33 may need to be decreased together with the moving speed of the linear antenna motor 35 during the data writing process, to thereby secure enough time for completion of data writing. Further, once the data writing on the wireless tag M is completed, the moving speed of the wireless tag M may be accelerated.

Proper moving speeds of the wireless tag M and the wireless tag antenna 34 may be determined through experiments of performing the data writing while moving the wireless tag M and the wireless tag antenna 34 at various speeds. For example, the speed of printing on the backing sheet D may be set within the range from 10 IPS (Inch Per Second) to 14 IPS. In one experiment, it was shown that while the backing sheet D and the wireless tag M are moving at the above speed, it is possible to write data on the wireless tag M by moving the wireless tag antenna 34 along the wireless tag M at the same speed.

As described above, in this embodiment, since the backing sheet conveying mechanism continues to operate without any interruption during the data writing process on the wireless tag M, the overall processing speed may not be deteriorated due to the data writing process. As such, the present embodiment provides a printing device and the data writing method thereof, enabling expeditious printing and data writing.

After completion of the data writing process as described above, the backing sheet D arrives at the thermal head 14 and the printing process is performed on the label 41 by the thermal head 14. Then, the label 41 is cut by a cutter (not illustrated) together with the backing sheet D and provided to the outside of the printing device 1.

Alternatively, the data writing process on the wireless tag M may be performed concurrently with the printing process on the label 41 by the thermal head 14, after the backing sheet D arrives at the thermal head 14.

As used in this application, entities for executing the operations can refer to a computer-related entity, either hardware, a combination of hardware and software, software, or software in execution. For example, an entity for executing an operation can be, but is not limited to being, a process running on a processor, a processor, an object, an executable, a thread of execution, a program, and a computer. By way of illustration, both an application running on an apparatus and the apparatus can be an entity. One or more entities can reside within a process and/or thread of execution and an entity can be localized on one apparatus and/or distributed between two or more apparatuses.

The program for realizing the functions can be recorded in the apparatus, can be downloaded through a network to the apparatus or can be installed in the apparatus from a computer readable storage medium storing the program therein. A form of the computer readable storage medium can be any form as long as the computer readable storage medium can store programs and is readable by the apparatus such as a disk type ROM and a solid-state computer storage media. The functions obtained by installation or download in advance in this way can be realized in cooperation with an OS (Operating System) in the apparatus.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printing device comprising:

a printing unit configured to print on a recording medium including a wireless tag;

a conveying unit configured to convey the recording medium to the printing unit along a conveying path;

an antenna unit configured to write data on the wireless tag by radiating an electromagnetic wave;

a moving unit configured to move the antenna unit along the conveying path; and a control unit configured to control the moving unit to move the antenna unit so that the antenna unit is capable of writing data on the wireless tag, while the conveying unit is conveying the recording medium to the printing unit.

2. The device of claim 1, wherein the control unit is configured to control the moving unit to move the antenna unit substantially at the same speed of the conveying of the recording medium by the conveying unit.

3. The device of claim 1, wherein the moving unit comprises:

a linear sensor configured to detect a position of the antenna unit; and a linear motor configured to move the antenna unit.

4. The device of claim 1, wherein the control unit is configured to determine a current position of the wireless tag based on a current conveying speed of the conveying unit and a previous position and a size of the wireless tag and configured to control the moving unit to move the antenna unit to reach the determined current position of the wireless tag.

5. The device of claim 4, wherein the control unit is configured to obtain at least one value of a size of a plurality of labels on a backing sheet of the recording medium, an attachment position of the wireless tag with respect to the label and a space between the labels and determine the current position of the wireless tag based on the obtained value.

6. The device of claim 4, wherein the control unit is configured to control the moving unit to move the antenna unit so that the wireless tag is positioned within a communication range of the antenna unit.

7. The device of claim 1, further comprising a label sensor configured to detect a label on a backing sheet of the recording medium by detecting a light transmittance or a light reflectivity of the recording medium.

8. A data writing method of a printing device, the printing device including a printing unit configured to print on a recording medium including a wireless tag and an antenna unit configured to write data on the wireless tag by radiating an electromagnetic wave, the method comprising:

moving the antenna unit so that the antenna unit is capable of writing the data on the recording medium, while the recording medium is being conveyed to the printing unit.

9. The method of claim 8, wherein moving the antenna unit comprises moving the antenna unit substantially at the same speed of conveying the recording medium.

10. The method of claim 8, further comprising detecting a position of the antenna unit by using a linear sensor and moving the antenna unit by using a linear motor.

11. The method of claim 8, further comprising:

determining a current position of the wireless tag based on a current speed of conveying the recording medium and a previous position and a size of the wireless tag; and moving the antenna unit to reach the determined current position of the wireless tag.

12. The method of claim 11, further comprising:

obtaining values of a size of a plurality of labels on a backing sheet of the recording medium, a position of the wireless tag with respect to the label and a space between the labels; and determining the current position of the wireless tag based on the obtained value.

13. The method of claim 11, wherein moving the antenna unit comprises moving the antenna unit so that the wireless tag is positioned within a communication range of the antenna unit.

14. The method of claim 8, further comprising detecting a label on a backing sheet of the recording medium by detecting a light transmittance or a light reflectivity of the recording medium.

* * * * *